US005188166A

United States Patent [19]

Perry

[11] Patent Number: 5,188,166

[45] Date of Patent: Feb. 23, 1993

[54] ROTARY STRIP CASTER EDGE CONTAINMENT

[75] Inventor: Robert M. Perry, Hensingham, Great Britain

[73] Assignee: Davy (Distington) Limited, Cumbria, England

[21] Appl. No.: 776,307

[22] PCT Filed: May 10, 1990

[86] PCT No.: PCT/GB90/00722

§ 371 Date: Dec. 18, 1991

§ 102(e) Date: Dec. 18, 1991

[87] PCT Pub. No.: WO90/13376

PCT Pub. Date: Nov. 15, 1990

[30] Foreign Application Priority Data

May 12, 1989 [GB] United Kingdom ..... 8910906

[51] Int. Cl.[5] ..... B22D 11/06

[52] U.S. Cl. ..... 164/416; 164/428

[58] Field of Search ..... 164/428, 480, 416, 478

[56] References Cited

U.S. PATENT DOCUMENTS 4,723,590 2/1988 Yamauchi et al. ..... 164/428

FOREIGN PATENT DOCUMENTS 60-166146 8/1985 Japan ..... 164/428
62-156052 7/1987 Japan ..... 164/428
62-259642 11/1987 Japan ..... 164/428
63-180348 7/1988 Japan ..... 164/480
64-40148 2/1989 Japan ..... 164/428

OTHER PUBLICATIONS

Abstract of Japanese Patent Publication 57-130743 published Aug. 13, 1982.

*Primary Examiner*—J. Reed Batten, Jr.
*Attorney, Agent, or Firm*—Lee, Mann, Smith, McWilliams, Sweeney & Ohlson

[57] ABSTRACT

A twin roll strip casting machine has an edge containment assembly abutting against opposite ends of the rolls. Each assembly has a face portion of refractory material supported by a backing plate. The assemblies are oscillated at up to ultrasonic frequencies in directions parallel to the direction of casting with the face portions urged into contact with the ends of the roll barrels.

8 Claims, 3 Drawing Sheets

ROTARY STRIP CASTER EDGE CONTAINMENT

This invention relates to a twin roll strip casting machine in which molten metals, especially steel, can be cast in the form of thin strip. In particular, this invention relates to apparatus for edge containment at the ends of the rolls of the twin roll casting machine.

In this specification, the expression "molten metal" includes liquid metal having a solid fraction.

A twin roll strip casting machine has molten metal fed into the area defined by the barrel lengths of the two working rolls and the containment members at the two ends of the rolls. The metal at the free surface in this area will freeze along each roll barrel, forming a shell. As the rolls rotate, each shell will grow as more metal freezes to it. The two shells are forced together as they pass through the nip between the two rolls.

It is possible that a shell may also be formed on the face of each edge containment member, especially if the edge containment member is nonwetting and its thermal conductivity is great enough to remove sufficient superheat and latent heat for solidification to commence. At the free surface, any shells formed against the edge containment members will be attached to the shells formed against the roll barrels. At any instant during casting, each edge containment shell will be widest at the free surface and tapered, according to the roll barrel profile, to a minimum width (product thickness) where the roll gap is least. Thus, during casting, the rolls must do most work on the edge containment shells to reduce their thickness and this can cause rippling of the edges of the strip thereby producing strip of poor quality.

It has been proposed to overcome this problem by arranging for the edge containment members to be partially or completely of refractory material thereby reducing the tendency for shells to form against them.

It is known from JP-A-87-259644 for edge containment members to be of refractory material and for them to be mounted on back-up plates. The containment member at one end of the rolls of a twin roll casting machine is oscillatable at up to ultrasonic frequency. The direction of oscillation is parallel to the longitudinal axes of the rolls. With this arrangement, therefore, the oscillating containment member moves towards and away from the ends of the roll barrels permitting molten metal to penetrate into the space between the roll barrels and the containment member.

In accordance with the present invention a twin roll strip casting machine has a pair of edge containment assemblies abutting against the ends of the roll barrels at opposite ends of the rolls, each of the assemblies comprising a face portion of refractory material supported by a backing plate and means for oscillating the assemblies, characterised in that means are provided to urge the assemblies towards the roll barrels such that the face portions of the assemblies are in contact with the ends of the roll barrels and the oscillating means oscillate both assemblies in directions parallel to the direction of casting with the face portions remaining in contact with the ends of the roll barrels.

In use, the refractory material will minimise shell growth on the face portions of the assemblies and solidified metal which is formed is shaken off by the oscillation to form centres for crystal growth.

By oscillating the assemblies in the direction of casting, it means that the face portions remain in contact with the ends of the roll barrels thereby preventing molten metal from penetrating between the ends of the roll barrels and the face portions.

By oscillating the assemblies parallel to the direction of casting, it means that any side spread occurring from rolling the two shells together will be forced into the same portion of the end assembly. This portion of the end assembly can be suitably shaped from a material to eliminate wear/erosion problems.

It is advantageous to be able to oscillate both the assemblies from a single source of ultrasonic oscillation. The source of oscillation may be hydraulic, electromechanical, pneumatic, electromagnetic, or any combination. The frequency of oscillation may be up to 5000 Hz.

In use, the frequency, stroke length and stroke waveform or any combination, may be adjusted to give a constant relationship between casting speed and containment assembly oscillation frequency to produce a strip with consistent edge properties.

The life of the refractory material, which constitutes the face portion of each assembly may be extended by cooling the backing plate to which it is attached. The refractory material may be SYALON silicon oxide, silicon nitride, boron nitride, zirconia, etc., or a combination of differing materials with a suitable bonding agent. The materials and bonding agent must have poor wetability and poor thermal conductivity. To reduce the possibility of shells forming on the face portion of refractory material, electrical heaters may be associated therewith.

The refractory material may be a refractory metal, such as molybdenum, a molybdenum alloy, etc., or any combination with refractory ceramics, to give optimum properties outlined earlier. In order to prevent oxidation, an inert gas, such as argon, should be added to the assembly to keep oxygen in air away from refractories.

The refractory material rubs against the roll barrel end faces and this rubbing will create a resistance to rolling and produce heat which will affect the mechanical properties of the roll barrels and shell growth in the near vicinity. To this end, a high temperature lubricant is placed so as to act between refractory material and the roll to improve this situation. The lubricant may be volatile as long as the resultant effluent does not affect the metal being cast. The effluent would rise from the refractory material/roll face to float to the meniscus in the roll gap to minimise any shell growth that may occur on the refractory material by a washing effect.

The elimination of freezing to the face of the refractory material may also be achieved by making the refractory material porous and passing an inert gas, such as argon, through it. The inert gas would also act as a coolant to reduce the thermal load on the rolls. Such a system would also reduce shell growth locally at the roll edges. The system would benefit from this by reducing the side spread from the rolling action arising from bringing the two moving shells together above the point where the rolls are closest.

The side spread must either be mechanically eliminated, by including for an opposing force at the appropriate location or, alternatively, it may be allowed to occur whilst ensuring no leakage of metal. Any system to reduce side spread will improve refractory life whilst minimising variations in strip width.

In any edge containment system where movement of any sort is included, the prime mover must be distant from the molten metal to prevent damage from metal splash and any radiant heat. This is readily achieved by including a rigid further arm pivoted about a position between the prime mover and the rolls.

In order that the invention may be more readily understood, it will now be described, by way of example only, with reference to the accompanying drawings, in which.

Figure 1:
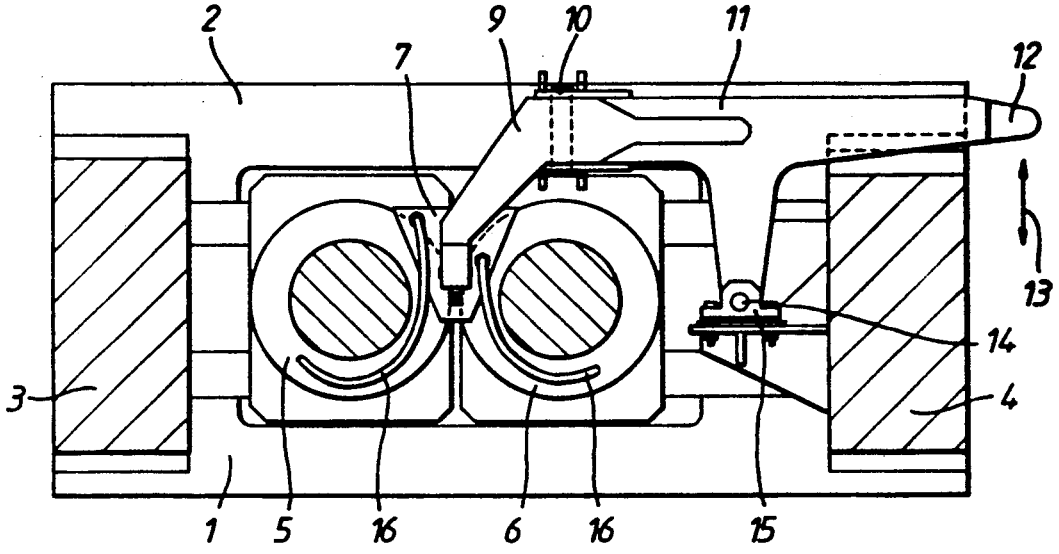
FIG. 1 is a sectional elevational view on A—A in FIG. 2 of a twin roll strip casting machine in accordance with one embodiment of the invention.
Figure 2:
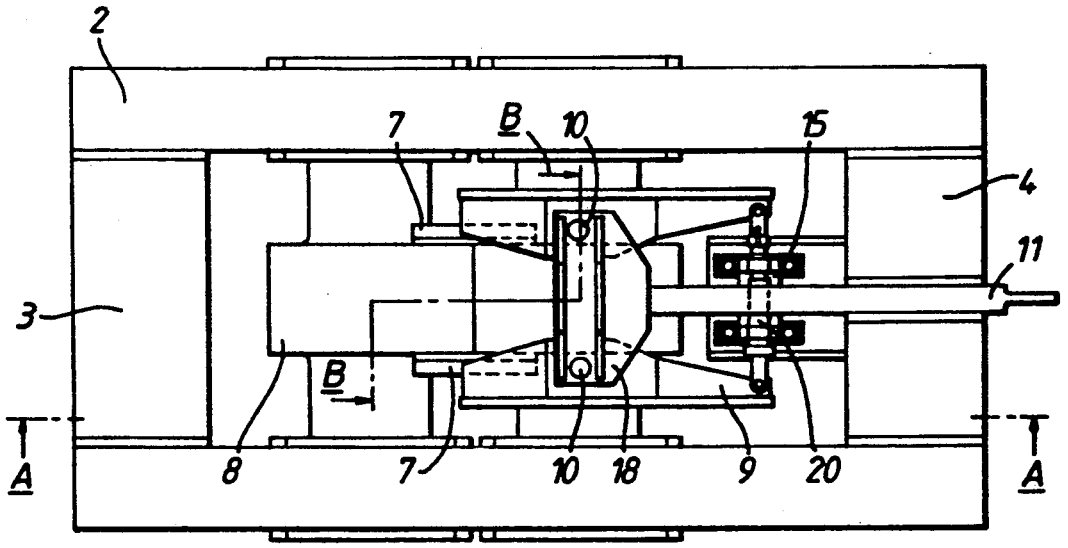
FIG. 2 is a plan view of FIG. 1.

FIGS. 1 and 2 show a two-piece housing comprising 'U' frame 1 and top beam 2 connected by cross beams 3 and 4 to a similar housing to form a stand for the caster. Horizontal roll assemblies 5 and 6 are contained within the stand. Edge containment assemblies 7 abut the roll barrel ends 8 and are connected to load arms 9. The load arms 9 are connected via pins 10 to a cross member on an oscillatable further arm 11 whose end 12 is connected to an oscillator (not shown) which acts in the directions indicated by the twin ended arrow 13. Arm 11 pivots about a pin 14 located in a housing 15 which is bolted to crossbeam 4 and extending in the direction of the roll axes. The oscillator is located behind cross beam 4 which protects it from heat and metal splash. The oscillator may be mounted on the mill structure or on a separate free standing frame.

FIG. 2 shows the pins 10 as being vertically mounted to both sides of cross member 18 of the arm 11 to pass through a suitable extension of loading arms 9. One end of each loading arm 9 is compliantly fixed to the respective assembly 7 whilst the other end of both loading arms 9 are connected together by a loading assembly 20 which passes through, and is not connected to, arm 11.

Figure 6:
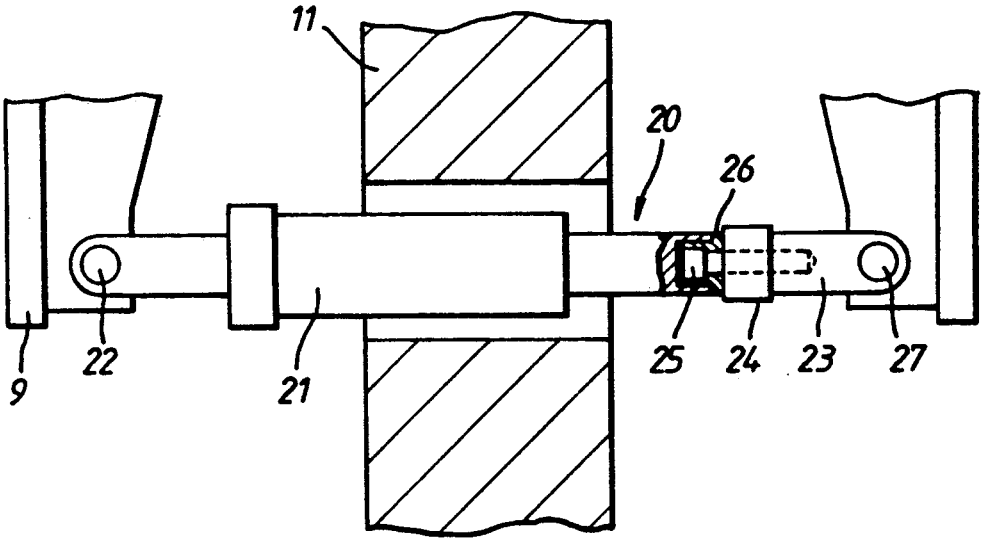
FIG. 6 is a detailed view of the side spread opposing arrangement shown in FIG. 2.

The loading assembly 20 shown in FIGS. 2 and 6 comprises a fluid operable cylinder 21 connected to one arm 9 by pin 22 and to the other arm 9 by screwed insert 26, load cell 24, bolt 25, clevis 23, and pin 27. The cylinder 21 is pressurised to extend and react to any side spread loads. The pressure may be varied according to the casting conditions within the mill and monitored by the load cell 24.

Cooling water supply and return flexible hoses 16 to and from the backing plates of the assemblies 7 and the arms 9 are shown in their working locations around the roll journals between roll barrels 17 and bearing housings in a position where damage from metal splash will be minimal.

Figure 3:
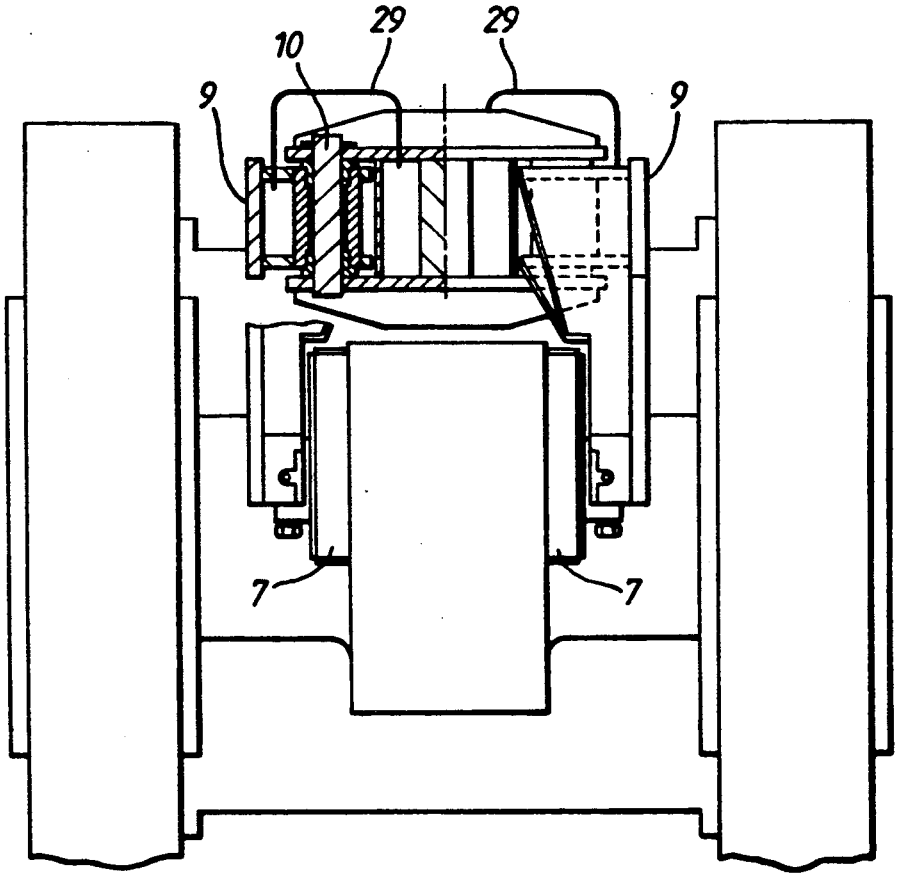
FIG. 3 is a split sectional elevation on B—B of FIG. 2.
Figure 4:
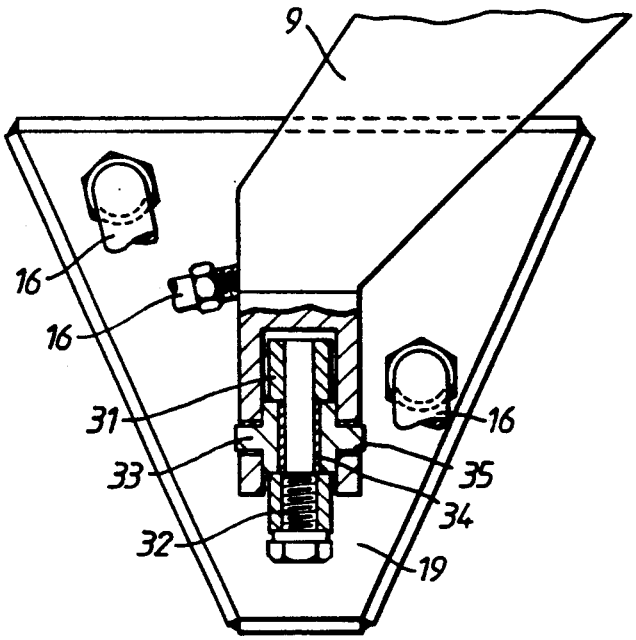
FIG. 4 is an end view of part of an edge containment assembly.

FIG. 3 shows the water hoses 16 feeding containment assemblies 7 and loading arms 9. Water enters one loading arm, as shown in FIG. 4, at position 28. The water passes through the arm to exit at the top adjacent to pin 10. The water then passes via flexible hoses 29 to end 18 of arm 11. After passing through end 18 of arm 11, the water passes through a second flexible hose 29 to the opposite loading arm 9 from where it exits from position 28, This system cools all items close to, but not touching, the molten metal.

Figure 5:
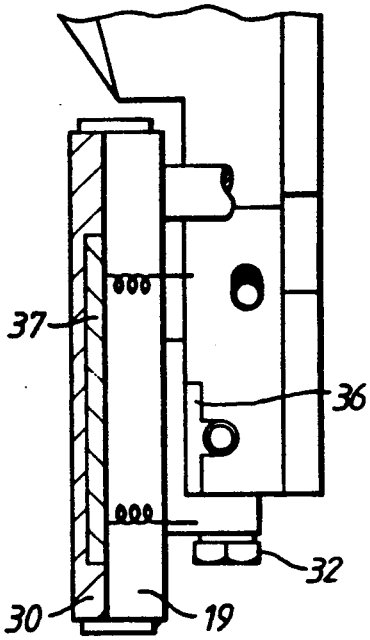
FIG. 5 is a sectional view of FIG. 4.

The edge containment assemblies 7 are shown in detail in FIGS. 4 and 5. The refractory material 30 which forms the front face portion abutting the roll barrel 8 is joined by suitable fixings, dependent upon material, to the backing plate 19 which is a truncated triangle in shape. The backing plate 19 is constructed to form an enclosed sandwich with internal distribution baffles for water which has an inlet and outlet, as indicated. The back face of the backing plate 19 includes a split block 31 through which fits a pivot screw 32 which is threaded into the lower half of the split block 31. A plain section of the pivot screw 32 passes through bushes 34 in a gimbal block 33.

The gimbal block 33 has two circular shaft extensions each of which fit into bushes 35. The bushes 35 are located in the lower portions of loading arms 9 and fixed by clamp 36.

The system can be adapted to have two separate oscillation pivot points from which two short levers can be connected to the end dam assembly with only one arm connected to the oscillating drive to give a more true vertical movement.

A heater 37 for heating the face portion of the refractory material 30 which abuts the roll barrel 8 may be provided. It is preferred that the heater comprise one or more electrical heaters.

I claim:

1. A twin roll strip casting machine having a pair of rotatable rolls each of which has a roll barrel, said rolls being arranged with the roll barrels in side-by-side spaced apart relation with their axes of rotation horizontal;

a first edge containment assembly located at one end of the roll barrel of one roll and at the corresponding end of the roll barrel of the other roll;

a second edge containment assembly located at the opposite end of the roll barrel of said one roll and at the corresponding end of the roll barrel of the other roll;

each of said assemblies comprising a face portion of refractory material supported by a backing plate;

means for urging the first edge containment assembly towards the ends of the roll barrels such that the face portion is in abutting relation with said ends of the roll barrels;

means for urging the second edge containment assembly towards the opposite ends of the roll barrels such that the face portion is in abutting relation with said ends of the roll barrels;

said roll barrels and the edge containment assemblies defining a reservoir for receiving molten metal to flow downwardly between the rolls to form a thin strip casting; and means for oscillating the containment assemblies upwardly and downwardly with the face portions remaining in contact with the ends of the roll barrels.

2. A twin roll casting machine as claimed in claim 1, wherein each assembly has a face portion of porous refractory material.

3. A twin roll casting machine as claimed in claim 1, wherein the oscillating means is capable of oscillating the assembles at up to ultrasonic frequencies.

4. A twin roll strip casting machine as claimed in claim 1, including a pair of support arms, each of which has a pair of opposite ends and is pivotable at a position intermediate its ends about a vertical axis, supports a respective one of the edge containment assemblies at one end and has means operable at the other end for pivoting the arm to abut the edge containment assembly against the ends of the roll barrels.

5. A twin roll strip casting machine as claimed in claim 1, wherein the backing plate of each edge containment assembly is connected to said end of the support arm by means of a gimbal mechanism which permits relative movement between the arm and the backing plate in two mutually perpendicular directions.

6. A twin roll strip casting machine as claimed in claim 1, including a further elongate arm pivotable about an axis extending parallel to the axes of rotation of the rolls, a cross member on the further arm extending parallel to the axes of rotation of the rolls, said support arms being pivotally mounted on said cross member.

7. A twin roll strip casting machine as claimed in claim 1, wherein the backing plate of each assembly is provided with means for the flow of cooling fluid therethrough.

8. A twin roll strip casting machine as claimed in claim 1, wherein the face portion of each assembly has an electrical heater associated therewith for heating the face portion.

* * * * *